US006047922A

United States Patent [19]

Michalik

[11] Patent Number: 6,047,922

[45] Date of Patent: Apr. 11, 2000

[54] TURNING-BAR ARRANGEMENT

[75] Inventor: Horst Bernhard Michalik, Höchberg, Germany

[73] Assignee: Koenig & Bauer Aktiengesellschaft, Wurzburg, Germany

[21] Appl. No.: 09/147,211

[22] PCT Filed: Apr. 21, 1997

[86] PCT No.: PCT/DE97/00790

§ 371 Date: Oct. 29, 1998

§ 102(e) Date: Oct. 29, 1998

[87] PCT Pub. No.: WO97/40985

PCT Pub. Date: Nov. 6, 1997

[30] Foreign Application Priority Data

Apr. 29, 1996 [DE] Germany ..... 196 16 894
Oct. 4, 1996 [DE] Germany ..... 196 40 978

[51] Int. Cl.[7] ..... B65H 23/32
[52] U.S. Cl. ..... 242/615.21
[58] Field of Search ..... 242/615.21

[56] References Cited

U.S. PATENT DOCUMENTS 1,610,671 12/1926 Funk .
3,809,303 5/1974 Brunner .
5,100,117 3/1992 Hajek et al. .
5,121,910 6/1992 Hajek et al. .
5,263,414 11/1993 Lehrrieder et al. .

FOREIGN PATENT DOCUMENTS 0444413 4/1991 European Pat. Off. .
0553740 1/1993 European Pat. Off. .
2447656 9/1975 Germany .
4013229 11/1991 Germany .
4-169460 6/1992 Japan .

OTHER PUBLICATIONS

Der Polygraph May 5, 1970 pp. 562–564.

*Primary Examiner*—John M. Jillions
*Attorney, Agent, or Firm*—Jones, Tullar & Cooper, P.C.

[57] ABSTRACT

A turning bar arrangement for material webs in a printing press uses first and second pairs of turning bars in a turning deck. The turning bars in the first pair are offset by 90° with respect to the turning bars in the second pair. Ends of the turning bars are supported in linear guides that are longer than the width of the printing press. Ends of the turning bars can project outside of the side frames of the printing press.

6 Claims, 5 Drawing Sheets

TURNING-BAR ARRANGEMENT

FIELD OF THE INVENTION

The present invention relates to a turning bar arrangement for material webs, in particular paper webs of a rotary printing press.

DESCRIPTION OF THE PRIOR ART

It is generally known to change turning bars, i.e. to change their axial position by 90°, in connection with a production change of the rotary printing press. It is therefore necessary for the air outlet openings in the turning bar to be located on the side around which the paper web is wound. To accomplish this end, a turning bar arrangement for guiding of ribbons above each other is proposed in DE 40 13 229 C1, wherein an angled turning bar is arranged in a first plane, and a parallel turning bar is arranged in a second plane. In case of a production change, the turning bars are shifted, and in the process their functions are simultaneously exchanged. It is required to this end to guide the incoming paper web, or respectively the incoming paper ribbon, into another plane, or respectively another level.

In this prior art device, it is disadvantageous that the shifting of the turning bars from one operating position via an extended 45° center position into another operating position requires approximately 50% more structural space.

Further than that, because of the wear of the components at the turning and pivoting points of the turning bars, the exact reproduction of an operating position is not a certainty.

In accordance with another prior art variation in DE 40 13 229 C1, the turning bars are seated overhung, rotatable by 90° and height-adjustable. The above mentioned disadvantages also apply in this case.

Together, both prior art arrangements have the disadvantage that quarter-width paper webs cannot be intermixed into the newspaper in all positions. This is impossible because the displacement and shifting of the turning bars can only take place within the inside width of the lateral frame.

DE 2447656 A1 describes a turning bar arrangement with two pairs of turning bars. These are arranged one on top of the other and are crossed in respect to each other.

U.S. Pat. No. 3,809,303 discloses turning bars which can be displaced on longitudinal guides.

It is the object of the present invention to create a turning bar arrangement.

This object is attained in accordance with the present invention by providing a turning bar arrangement for material webs that has at least one turning deck. A first pair of turning bars and a second pair of turning bars are provided. The second pair of turning bars is located underneath the first pair of turning bars. The first pair of turning bars is arranged horizontally, and at an angle of 45° with respect to the running direction of the incoming material web and is supported by two spaced lateral frames. The second pair of turning bars are offset by 90° with respect to the first pair of turning bars.

The advantages which can be achieved by means of the present invention lie, in particular, in that components as well as elaborate mechanisms for the shifting of turning bars are omitted. A correct angular web deflection position of the turning bars is assured in every case, because of which tension differences in the paper web across the width of the paper web are prevented. Also, no mechanisms for the height adjustment of turning bars, nor mechanisms for changing the position or the function of air outlet openings are required. No readjustment of the deflection angle of the turning bars is necessary when the paper web guidance is changed.

A web deflection angle adjustment is required only at or prior to the first start-up. Rotating or pivoting of the turning bars, with changes of the paper web guidance, can be omitted.

It is only necessary to displace the turning bars parallel in respect to each other in the horizontal direction. In the process, they always remain exactly parallel.

A further advantage is achieved by the possibility of now installing a paper draw-in device acting in only one direction in the turning decks.

Finally, the refitting times during production changes are reduced in that the elaborate changing of the turning bars into a different angular web deflection position can be omitted.

BRIEF DESCRIPTION OF THE DRAWINGS

Several preferred embodiments of the present invention are represented in the drawings, which will be described in more detail in what follows.

Shown are in.

DESCRIPTION OF THE PREFERRED EMBODIMENTS

Figure 1:
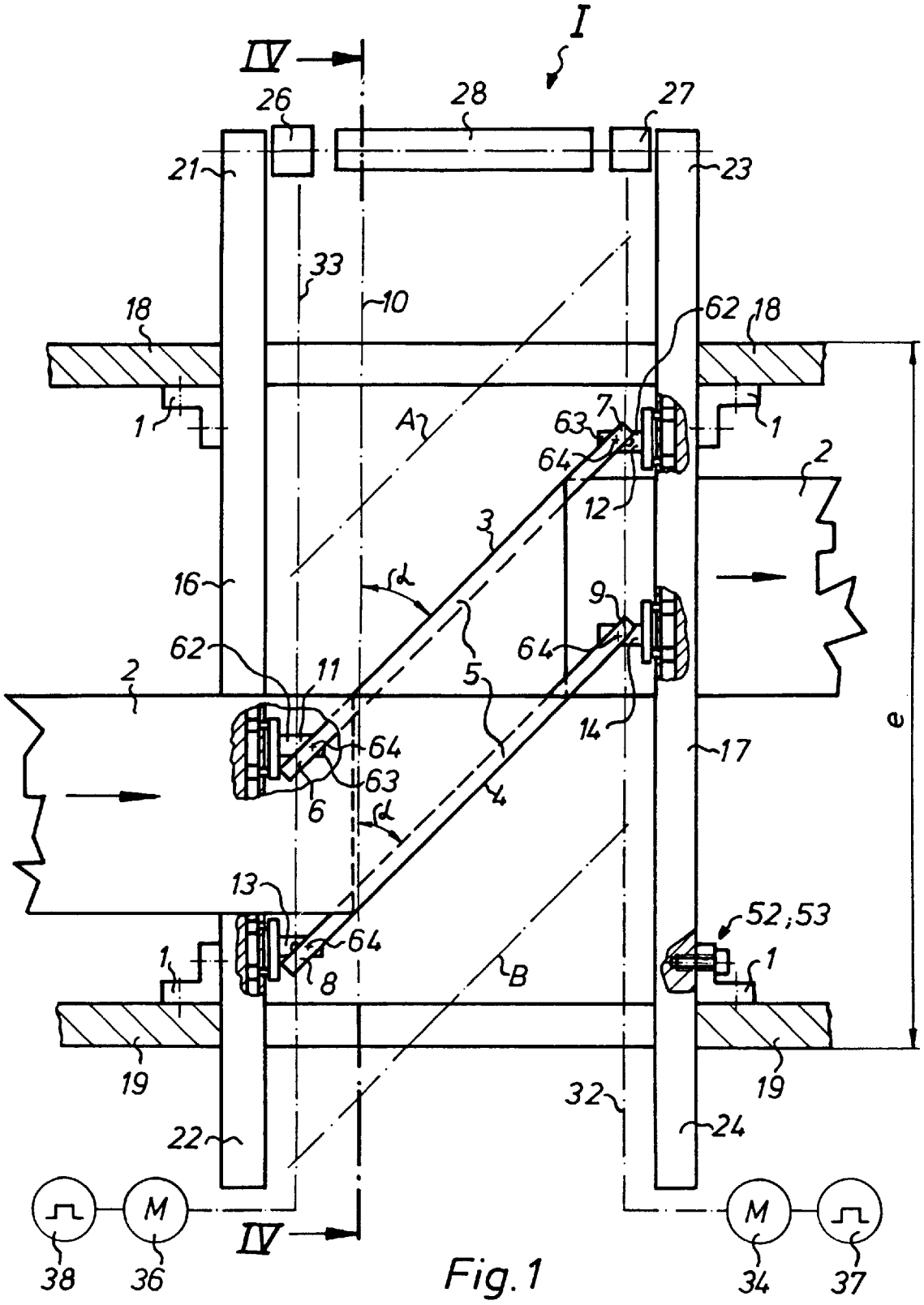
FIG. 1, a schematic representation of a top view on a turning bar arrangement in a first paper web plane of a turning web deck with two paper web planes, FIG. 2, an enlarged representation of a cross section through a turning bar guidance in accordance with FIG. 1, but without a paper web, FIG. 3, a representation analogous with FIG. 1, but with turning bars arranged offset by 90° in a second paper guide plane of the turning deck with two paper web planes, FIG. 4, a lateral view of a second embodiment of a turning bar arrangement with three turning decks with two paper web planes each, and a representation of the section IV—IV in FIG. 1 in the top paper web plane I and the representation of the section V—V in FIG. 3 in the top second paper web plane II, and in FIG. 5, a lateral view of a third embodiment of a turning bar arrangement with bay window operation.

Two turning bars 3, 4—identified as a first pair 5—of turning bars, required for turning a paper web 2 running in a first paper web plane I, are respectively arranged, displaceable in linear guides 16, 17 and on top of each other, by their two ends 6, 7, 8, 9 on turning bar supports 11, 12, 13, 14. The linear guides 16, 17 are made, for example, of extruded hollow profiles. The linear guides 16, 17 are spaced apart from each other and extend at right angles between both lateral frames 18, 19 and are fastened on the lateral frames 18, 19, for example by angle brackets 1.

Ends 21, 22, 23, 24 of the linear guides 16, 17 project through openings located in the lateral frames 18, 19, so that the length of the linear guides 16, 17 is greater than an absolute width "e" of the rotary printing press.

Together, the ends 21, 23 of the linear guides 16, 17 can support a paper guide roller 28, arranged in respective bearings 26, 27.

In the first paper guide plane I, the turning bars 3, 4 extend exclusively axially parallel in respect to each other, as seen in FIG. 1. In the course of turning a first half-width paper web 2 from the right to the left—always viewed in the direction of the running of the paper—the ends 6, 8 of the turning bars 3, 4, which are guided in the first linear guide 16, point in the direction toward the right lateral frame 19. The turning bars 3, 4 are displaceably arranged in the linear guides 16, 17 by means of their turning bar supports 11 to 14. To this end, the turning bar supports 12, 13 respectively have a threaded bore 29, 31, which is interlockingly engaged by a threaded spindle 32, 33 arranged parallel with the linear guide 17, 16, all as may be seen in FIG. 2. For example, the threaded spindles 32, 33 can each be seated fixed in place in the lateral frames 18, 19 and can be connected via a gear, not represented, with a hand wheel, or with a servo motor 34, 36, arranged fixed in place in the lateral frame. A locking brake, not represented, and a rotational angular position sensor 37, 38 are assigned to each servo motor 34, 36.

In this way, each turning bar 3, 4 can take up any required position on the linear guide 16, 17 within the range of a maximal displacement position A, B, represented by dash-dotted lines in FIG. 1. In this case, the ends 6 to 9 of the turning bars 3, 4 can also project past the absolute width e of the lateral frames 18 or 19 of the rotary printing press.

Figure 3:
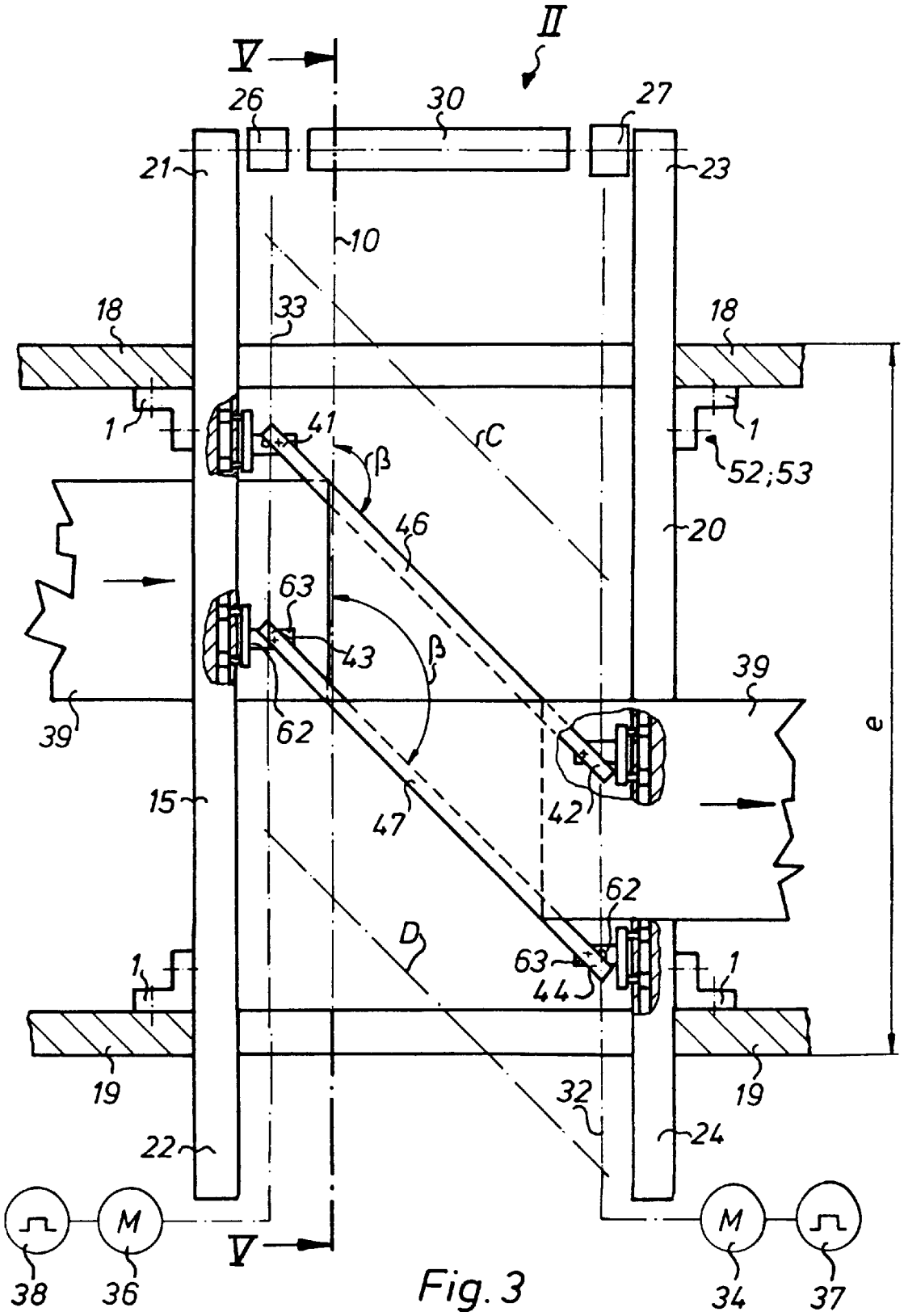
Figure 4:
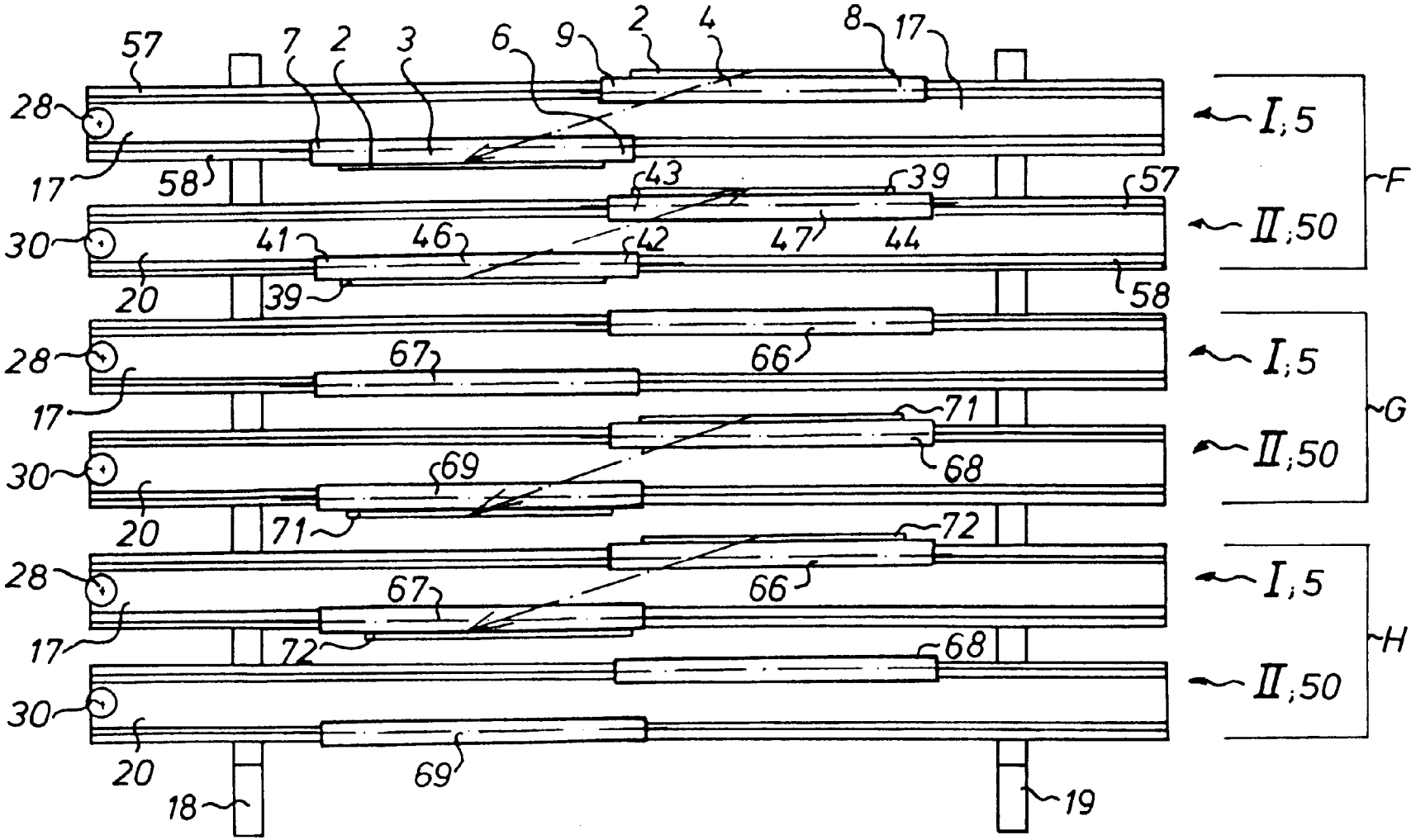

A second paper web plane II as seen in FIG. 3 is provided with a second pair 50 of turning bars 46, 47, which basically have the same construction as the paper web plane I and therefore use similar reference numerals, but which has several differences extends below a first paper web plane I with the first pair 5 of turning bars 3, 4. A second half-width paper web 39 is turned from the left to the right—always seen in the running direction of the paper. In this case the ends 41, 43 of turning bars 46, 47, which are guided in a first linear guide 15, point in the direction toward the left lateral frame 18, while the other ends 42, 44 of the turning bars 46, 47 are guided in a linear guide 20. This means that the first pair 5 of turning bars 3, 4 of the first paper web plane I of a first turning deck F, as seen in FIG. 4 with two paper web planes, hereinafter respectively called deck F, is arranged offset by 90° and non-pivotably in respect to a second pair 50 of turning bars 46, 47 of a second paper web plane II as seen in FIGS. 1 and 3. Expressed in other words, the first pair 5 of turning bars 3, 4 is horizontally arranged at an angle $\alpha$ of 45° in respect to a vertical plane 10, as shown in FIG. 1. The second pair 50 of turning bars 46, 47 is arranged below the first pair 5 and horizontally at an angle $\beta$ of $\alpha$+90°=135° in respect to the vertical plane 10 as seen in FIG. 3.

The turning bars 46, 47 guided in the second paper web plane II also can take up any position on a linear guide 15, 20 within the range of a maximal displacement position C, D—represented by dash-dotted lines as seen in FIG. 3.

The turning bars 3, 4 or 46, 47 of each paper web plane I or II are respectively arranged axis-parallel in respect to each other and are each displaceable in a horizontal direction. The ends 21, 23 of the linear guide 15, 20 in the second paper web plane II respectively support a paper guide roller 30 arranged in bearings 26, 27.

Figure 2:
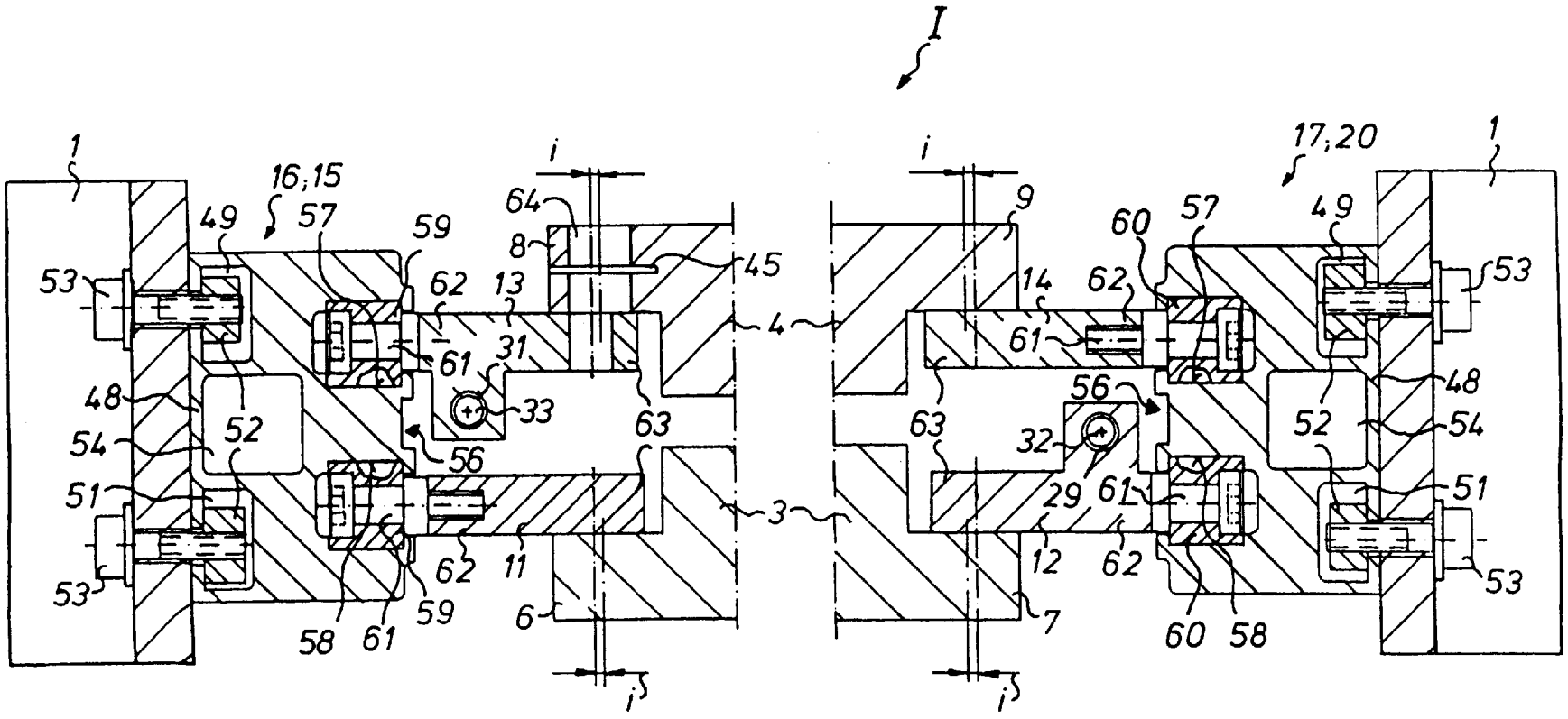

Each linear guide 16, 17 or 15, 20 is respectively embodied, for example as an extruded multi-chamber hollow profile—for example made of aluminum—with a cross section in the approximate shape of a rectangular contour, as depicted in FIG. 2. Each multi-chamber hollow profile has, on the first longitudinal side 48 facing the lateral frames 18, 19, two grooves 49, 51, arranged one above the other, for receiving fastening elements, for example respectively one strip 52 with threaded bores for fastening screws 53, which connect the hollow profile with the angled profile 1. C-shaped profiles can also be arranged in place of the grooves 49, 51. A hollow chamber 54 for receiving supply lines and/or compressed air can be located on the same side 48 and between the grooves 49, 51.

On a second longitudinal side 56 facing the turning bars 3, 4, 46, 47, the hollow profile of the linear guides 16, 17, 15, 20 has two profiles 57, 58, which are arranged above each other and are embodied in a C-shape in cross section. The profiles 57, 58 are open in the direction of the second longitudinal side 56. Sliding blocks 59 which, for example are made of plastic material, run inside these C-shaped profiles, and are connected by means of bolts 61, extending through the openings of the C-profiles 57, 58, with first ends 62 of the turning bar supports 11 to 14. A second end 63 of the turning bar supports 11 to 14 can respectively be connected fixedly, or respectively rigidly, with the end 6, 7, 8, 9 of the turning bars 3, 4, 46, 47. In accordance with another variation, the second ends 63 of the turning bar supports 11 to 14 are respectively connected with the ends 6 to 9 of the turning table supports 3, 4, 46, 47, respectively via an angular adjustment device. Such an angular adjustment device can consist, for example, of an eccentric 64, wherein a bolt is eccentrically formed up to approximately half of its length "i" as seen in the top left in FIG. 2. Thus the above mentioned elements, for example 8, 63, can be moved in relation to each other. After performing a one-time adjustment of the web deflection angle position, $\alpha/\beta$ of the turning bars 3, 4, 46, 47, the eccentric 64 can be secured against relative rotation in respect to the end 6 to 9 of the turning bar 3, 4, 46, 47, for example by the arrangement of a securing device 45, for example a splint.

In this way first ends 6, 63, 62, 8, 63, 62, and second ends 7, 63, 62, 9, 63, 62 of all turning bars 3, 4, 46, 47 are connected either directly with the associated sliding blocks 59, 60, or indirectly via the turning bar supports 11 to 14 with the associated sliding blocks 59, 60. In the latter case, deflection angle adjustability and, by means of the securing device 45, the fixation of the web deflection position of the turning bars 3, 4 or 46, 47 are provided. Thus the turning bars 3, 4 or 46, 47 of each paper web plane I or II are displaceably seated independently of each other in C-shaped guides 57, 58.

The sliding blocks 59, 60 are arranged so they can be locked via the turning bar supports 11 to 14 as well as via the threaded spindles 32, 33 and the brake of the servo motor 34, 36. Further than that, the multi-chamber hollow profile of the linear guides 16, 17, 15, 20 can have additional hollow chambers or conduits.

Since each turning bar 3, 4, 46, 47 is equipped with an adjustment and position response system 32 to 34 and 36 to 38, it is possible to bring up every position within the maximum displacement position A, B, C, D for the desired type of production by means of a computer or from the machine control position. First, a base position of the turning bars 3, 4, 46, 47 is brought up by means of the drive 34, 32, 36, 33. It is possible during production to make corrections of the running paper web 2, 39 by means of the drive 34, 32, 36, 33.

The compressed air which is to be supplied to the turning bars 3, 4, 46, 47 can be taken, for example, from the third hollow chamber 54, or also from another, unidentified hollow chamber of to the turning bars by the multi-chamber hollow profile 16, 17 15, 20, and conducted to the turning bars by known means, such as hoses or the like.

Each one of the decks F, G, H, as seen in FIG. 4 respectively, consists of two paper web planes I, II, in which each one of the paper web planes I or II can be produced in a modular way and assembled. Several decks F, G, H can be arranged one above the other, as shown in FIG. 4. The first and second paper web planes I and II represented in FIGS. 1 and 2 are arranged in deck F of FIG. 4. Respectively four turning bars 66 to 69 are located in each of the decks G, H. Of these, the turning bars 66, 67 respectively are positioned in the paper web plane I as the first pair 5, and the turning bars 68, 69 respectively are positioned in the paper web plane II as the second pair 50.

In this way, a paper web 2 is turned in deck F, paper web plane I, from the right side 19 to the left side 18 as seen in FIG. 1, and a paper web 39 is turned in the paper web plane II from the left side 18 to the right side 19 as seen in FIG. 2. A paper web 71 is turned in deck G, paper web plane II, from the left side 18 to the right side 19, and a paper web 72 is turned in the paper web plane I from the right side 19 to the left side 18.

Figure 5:
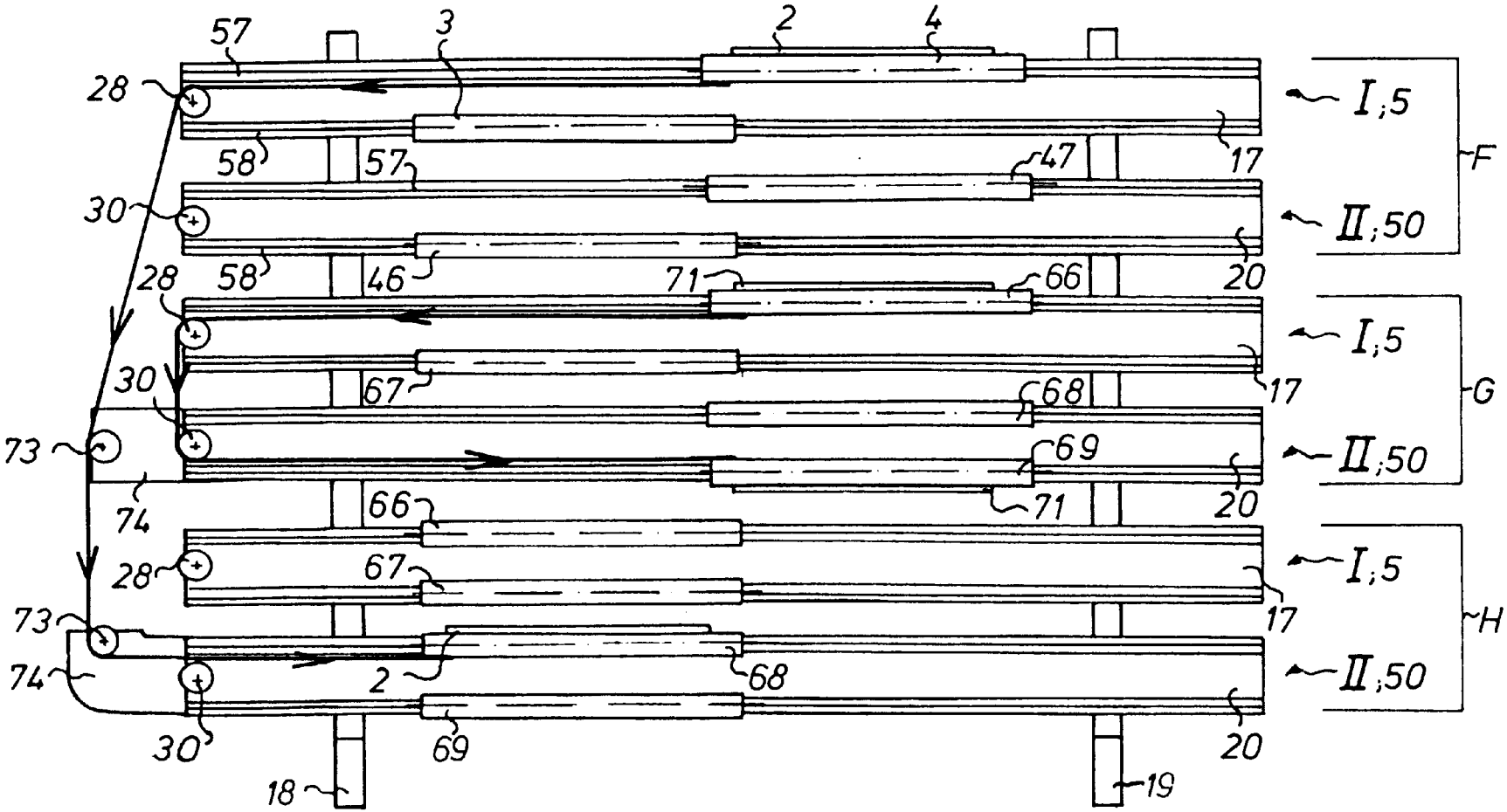

In accordance with another preferred embodiment it is also possible to laterally move a paper web 2 out of the deck F via paper guide rollers 28, 73, and to intermix it again in deck H. In this case, the paper web 2 has been simultaneously turned from the right side 19 to the left side 18 as seen in FIG. 5. The paper guide roller 73 additionally required for this process can be seated by means of a linear guide 74 fastened on the end of the linear guide 16, 17. In addition, half a paper web 71 is mixed in from the right side 19 of the paper web plane I into the right side 19 of the paper web plane II of the deck G. In contrast to the first embodiment variation shown in FIG. 4, the turning bars 69, 66, 68 depicted in FIG. 5 are in a changed position.

Reverse turning of paper webs is also possible.

A guide as described in EP 0 553 740 B1 is particularly suited for drawing in a paper web 2, 39 around a turning bar 3, 4 or 46, 47. In accordance with this, a continuously adjustable guide can be guided around an adjustable turning bar. While preferred embodiments of a turning bar arrangement in accordance with the present invention have been set forth fully and completely hereinabove, it will be apparent to one of skill in the art that changes in, for example, the type of material web being fed to the turning bar arrangement, the type of printing press used, and the like could be made without departing from the true spirit and scope of the present invention which is accordingly to be limited only by the following claims.

What is claimed is:

1. A turning bar arrangement for material webs comprising:

a first pair of turning bars and a second pair of turning bars, said first and second pairs of turning bars forming a first tuning deck, said first pair of turning bars being arranged parallel to each other and horizontally at an angle of 45° with respect to the running direction of the material web, said second pair of turning bars being arranged parallel to each other beneath said first pair of turning bars and being arranged offset by an angle of 90° with respect to said first pair of turning bars;

means for supporting each of said first and second pairs of turning bars between spaced lateral side frames for non-pivotable displacement of each of said first and second pairs of turning bars in a horizontal direction in response to production changes; and a second turning deck having third and fourth pairs of turning bars, said second turning desk being positioned beneath said first turning deck.

2. A turning bar arrangement for material webs comprising:

a first pair of turning bars and a second pair of turning bars, said first and second pairs of turning bars forming a first turning deck, said first pair of turning bars being arranged horizontally and at an angle of 45° with respect to the running direction of the material web, said second pair of turning bars being arranged beneath said first pair of turning bars and arranged offset by an angle of 90° with respect to said first pair of turning bars; and means for supporting said first and second pairs of turning bars between spaced lateral side frames for displacement in a horizontal direction in response to production changes, said lateral side frames being spaced apart from each other at a width and further wherein each of said linear guides has a length, said length being greater than said width, said means for supporting said first and second pairs of turning bars including linear guides associated with each of said first and second pair of turning bars, and means supporting ends of each of the turning bars of said first and second pair of turning bars in said linear guides.

3. The turning bar arrangement of claim 2 wherein each of said linear guides is an extruded hollow profile.

4. A turning bar arrangement for material webs comprising:

a first pair of turning bars and a second pair of turning bars, said first and second pairs of turning bars forming a first turning deck, said first pair of turning bars being arranged horizontally and at an angle of 45° with respect to the running direction of the material web, said second pair of turning bars being arranged beneath said first pair of turning bars and arranged offset by an angle of 90° with respect to said first pair of turning bars;

means for supporting said first and second pairs of turning bars between spaced lateral side frames for displacement in a horizontal direction in response to production changes;

each of the turning bars in each of said first and second pairs of turning bars having ends and wherein in at least one operating position of said turning bar arrangement at least one of said turning bar ends is positioned extending past an associated one of said lateral side frames.

5. A turning bar arrangement for material webs comprising:

a first pair of turning bars and a second pair of turning bars, said first and second pairs of turning bars forming a first turning deck, said first pair of turning bars being arranged horizontally and at an angle of 45° with respect to the running direction of the material web, said second pair of turning bars being arranged beneath said first pair of turning bars and arranged offset by an angle of 90° with respect to said first pair of turning bars;

means for supporting said first and second pairs of turning bars between spaced lateral side frames for displacement in a horizontal direction in response to production changes and including linear guides associated with each of said first and second pair of turning bars, and sliding blocks supporting said ends of each of the turning bars of said first and second pair of turning bars in said linear guides;

means to connect selected first or second ends of each of said turning bars to associated ones of said sliding blocks for hinged movement and for securement in place at a selected deflection angle; and an adjustable eccentric for positioning said selected first or second end of each of said turning bars at said selected deflection angle, and means for fixing each said associated turning bar end to prevent relative rotation.

6. The turning bar arrangement of claim 5 wherein said linear guides are supported by said spaced lateral side frames parallel to, and spaced apart from each other.

* * * * *